US006831985B2

(12) United States Patent
Takei

(10) Patent No.: US 6,831,985 B2
(45) Date of Patent: Dec. 14, 2004

(54) PIEZOELECTRIC SPEAKER

(76) Inventor: Toshitaka Takei, 10-9, Honfujisawa 1-chome, Fujisawa-shi, Kanagawa-ken (JP)

( * ) Notice: Subject to any disclaimer, the term of this patent is extended or adjusted under 35 U.S.C. 154(b) by 29 days.

(21) Appl. No.: 09/894,959

(22) Filed: Jun. 28, 2001

(65) Prior Publication Data

US 2002/0006208 A1 Jan. 17, 2002

(30) Foreign Application Priority Data

Jul. 13, 2000 (JP) ..... 2000-212171

(51) Int. Cl.[7] ..... H04R 25/00
(52) U.S. Cl. ..... 381/190; 381/426; 381/431
(58) Field of Search ..... 381/190, 191, 381/173, 176, 423, 426, 431; 181/170–172; 310/311, 322, 325

(56) References Cited

U.S. PATENT DOCUMENTS 5,889,871 A * 3/1999 Downs, Jr. ..... 381/190
6,427,017 B1 * 7/2002 Toki ..... 381/190

* cited by examiner

*Primary Examiner*—Suhan Ni
(74) *Attorney, Agent, or Firm*—Zito tlp; Joseph J. Zito; Kendal M. Sheets

(57) ABSTRACT

To provide a piezoelectric speaker in which a breakdown of an electric lead terminal due to a large amount electric current flow is prevented an electric accident due to hand touch to an electrode and a frame is prevented, the precision of position and shape of the electrode formed by masking is enhanced, and the generation of buzz sound that becomes noise is prevented, side frames fixing side ends of a vibrating diaphragm are sectioned into upper and lower plates by the side ends formed in a corrugate shape, and a vibrating diaphragm supporting portions of the upper and lower plates are formed in the same corrugate shape as that of the side ends so that the side ends are clamped by the vibrating diaphragm supporting portions in the state of the corrugate shape of the vibrating diaphragm being maintained, and partitioning plates are inserted between the side frames to partition crests and troughs of the vibrating diaphragm.

20 Claims, 8 Drawing Sheets

PIEZOELECTRIC SPEAKER

BACKGROUND OF THE INVENTION

The present invention relates to a piezoelectric speaker, and more particularly to a structure of a piezoelectric speaker in which a piezoelectric film is molded into a corrugate shape to form a vibrating diaphragm, and alternating signals are inputted into electrodes formed on the vibrating diaphragm to thereby generate sound wave.

A conventional speaker such as a Heil speaker or a ribbon speaker in which a thin film is molded into a corrugate shape and electrodes are formed to complete a vibrating diaphragm has been proposed. In the Heil speaker or ribbon speaker, both vertical ends in the vibrating diaphragm molded into a corrugate shape are fixed to a frame when the vibrating diaphragm is to be fixed to the frame. Both side ends that are wavy are not fixed and kept free. Since the electrodes formed on each crest and trough of the vibrating diaphragm are connected in series, the flowing current is also caused to flow through the electrodes connected in series.

FIG. 1 is a perspective view of a conventional piezoelectric speaker. In the corrugate shaped molded vibrating diaphragm 1, after the vertical ends 3-1 have been bonded to the vertical frames 2-1 and 2-2, the wavy side ends 4 are fixed to side frames 6-1 and 6-2 by adhesives 5. Also, electrode lead terminals 8-1 and 8-2 deposited on piezoelectric films 7-1 and 7-2 and external lead lines 9-1 and 9-2 are screw-fastened together to the vertical frames 2-1 and 2-2 of plastics by means of bolts 10-1 and 10-2. The acoustic signal current is inputted into the electrode lead terminals 8-1 and 8-2 from the external lead lines 9-1 and 9-2.

Accordingly, the current for driving the vibrating diaphragm 1 is inputted concentratedly from first ends of the narrow thin lead electrode terminals 8-1 and 8-2. However, since the electrodes 11 formed in the crests and troughs are connected in parallel, this system is different in electrode structure from the above-described Heil speaker or ribbon speaker.

However, if there would be no misunderstanding the representation of the numeral, only the main reference numeral will be used to collectively represent the components. This is the case also in other components that will be described hereunder. This rule will be applied to the components in the same manner.

However, since the above-described piezoelectric films 7 have a large static capacitance, if the frequency is increased, an impedance is lowered so that a large alternating current will flow. On the other hand, since the electrodes are manufactured by means of a thin coating method such as deposition, as shown in FIG. 1, all the signal applied to the electrodes is inputted from the electrode lead terminals 8-1 and 8-2 at first ends of the electrode leads 12-1 and 12-2 on the extension lines of the electrodes 11. For this reason, a large amount of current is caused to flow into the thin narrow electrode lead terminals 8-1 and 8-2. The electrode lead terminals 8-1 and 8-2 are evaporated to cause a breakdown of lines.

Also, as another problem, in order to generate a sufficient sound pressure in the piezoelectric speaker, the output voltage of an amplifier has to be further stepped up to apply a high voltage. Although it is not necessary to provide the voltage in the several kVs like a static speaker, since the peak voltage reaches about 100V even in the piezoelectric speaker, if the user's hand would touch the electrodes 11, the side frames 6-1 and 6-2, the vertical frames 2-1 and 2-2 and the like as shown in FIG. 1, there would be an electric accident.

Also, the conventional structure in which the vibrating diaphragm 1 formed by the piezoelectric film into the corrugate shape is fixed to the frame shown in FIG. 1 suffers from a problem that, if the sound pressure is somewhat increased, the vibrating diaphragm 1 is vibrated in universal directions to generate a busy sound at a predetermined frequency to generate noise.

SUMMARY OF THE INVENTION

Accordingly, an object of the present invention is to provide a piezoelectric speaker in which a breakdown of an electric lead terminal is prevented when a large amount current is caused flow into a thin narrow electrode lead terminal, any electric accident may be prevented in an electrode and a frame that would be likely to be touched by hands, the precision of position and shape of the electrode formed by using a mask is enhanced, and the generation of busy sound that becomes noise may be prevented even at a predetermined frequency of the vibrating diaphragm.

In order to attain the above objects, according to the present invention, there is provided a piezoelectric speaker comprising a vibrating diaphragm 1 formed by two piezoelectric films 7-1, 7-2 being put together and made in a bimorph type, and formed into a corrugate shape as the whole to have crests 16-1 and troughs 16-2 alternately and to have walls 17 which connect the crests 16-1 and the troughs 16-2 and structured such that side ends 4-1, 4-2 corresponding to the right and left ends of the vibrating diaphragm 1 are attached to side frames 6-1, 6-2 placed at the right and the left of the vibrating diaphragm 1 and one longitudinal end 3-1 and the other longitudinal end 3-2 of the vibrating diaphragm 1 are attached to vertical frames 2-1, 2-2 disposed between the right and left side frames 6-1, 6-2 and that electrodes 11-1, 11-2 are formed on the vibrating diaphragm 1 to generate sound waves by alternate signals being input to the electrodes 11-1, 11-2, wherein each of the right and left side frames 6-1, 6-2 fixing the right and left side ends 4-1, 4-2 of the vibrating diaphragm 1 is sectioned into an upper plate 19-1 and a lower plate 19-2 by the right side end 4-1 or the left side end 4-2 of the vibrating diaphragm 1 formed in the corrugate shape as the whole, and a vibrating diaphragm supporting portion 31 of the upper plate 19-1 and a vibrating diaphragm supporting portion 32 of the lower plate 19-2 are formed in the same corrugate shape as the corrugate shape of the side ends 4-1, 4-2 of the vibrating diaphragm 1 so that the side ends 4-1, 4-2 of the vibrating diaphragm supporting portion 31 of the upper plate 19-1 and the vibrating diaphragm supporting portion 32 of the lower plate 19-2 in the state of the corrugate shape of the vibrating diaphragm 1 being maintained.

According to this structure, the side ends 4-1, 4-2 of the vibrating diaphragm 1 formed into a corrugate shape are clamped by the pair of upper and lower plates 19-1, 19-2 the vibrating diaphragm supporting portions of which are formed in the corrugate shape, to form the side frames 6, 6-1, 6-2, and the electrodes 11-1, 11-2 formed on the surface of the vibrating diaphragm 1 are connected at a plurality of positions by conductive leads 20 mounted on the side frames 6-1, 6-2 to output.

Accordingly, it is possible to firmly fix the vibrating diaphragm 1 to the side frames 6-1, 6-2 and to prevent the current from concentrating on a local part of the thin electrode lead terminals 8-1, 8-2.

Furthermore, in the piezoelectric speaker according to the present invention, the vibrating diaphragm 1 is clamped by the upper plate 19-1 and the lower plate 19-2 in such a way that the side ends 4-1, 4-2 of the vibrating diaphragm 1 project from the side frames 6-1, 6-2, electrode leads 12-1, 12-2 are formed on projections 23 so projected, and the electrode leads 12-1, 12-2 are connected by the leads 20.

With such an arrangement, the side ends 4-1, 4-2 of the vibrating diaphragm 1 are fixed to the frame so as to project from the side frames 6-1, 6-2 composed of the pair of the upper and lower clamping plates 19-1, 19-2 and the electrode leads 12-1, 12-2 formed on the projecting projections 23 are attached to the leads 20 connected to the side frames 6-1, 6-2.

Accordingly, it is possible to readily and firmly connect the electrodes 11-1, 11-2 and the leads 20 with each other without any adverse affect to the vibrating surface at a plurality of positions.

In the piezoelectric speaker according to the present invention, a plurality of electrodes 11, 11-1, 11-2 are formed on the same surface of the vibrating diaphragm 1, electrodes 11, 11-1, 11-2 that are not in conductive communication with each other on the same surface are provided within the plurality of electrodes 11, 11-1, 11-2, and the electrodes 11, 11-1, 11-2 are electrically conductive by the lead 20.

According to the above-described arrangement, the pattern is made as shown in FIG. 3, instead of the insulative strip portion of the mask shown in FIG. 2, to thereby prevent the bends and displacement of the insulative portion. Then, the electrode leads 12, 12-1, 12-2 formed on the piezoelectric films 7, 7-1, 7-2 have disconnected portions on the midway and are not contiguous to the electrode lead terminals 8-1, 8-2. However, according to the invention of the first aspect, the respective electrodes 11, 11-1, 11-2 mounted on the side frames 6, 6-1, 6-2 are connected.

Accordingly, it is possible to enhance the positional precision of the electrodes 11, 11-1, 11-2 and to attain the prevention of the breakdown of the electrode lead terminals 8-1 and 8-2 at once.

Furthermore, in the piezoelectric speaker according to the present invention, partitioning plates 26-1, 26-2 are inserted between the two side frames 6-1, 6-2, and the crests 16-1 and the troughs 16-1 of the vibrating diaphragm 1 are partitioned by the partitioning plates 26-1, 26-2.

With such an arrangement, when the vibrating diaphragm 1 is vibrated while receiving the acoustic signal, the partitioning plates 26-1, 26-2 are inserted between the two side frames 6-1, 6-2 in order to prevent the lateral displacement or to prevent the resonance caused by the mutual affect of adjacent units of the crests 16-1 and troughs 16-2.

Accordingly, it is possible to prevent the user's finger from touching the vibrating diaphragm 1 by the partitioning plates 26-1, 26-2 to thereby serve as the sufficient countermeasure to the electrical accident and thus it is possible to solve the two different problems of the electrical accident and a buzz sound at a time.

Further, in the piezoelectric speaker according to the present invention, the partitioning plates 26-1, 26-2 are formed integrally with the side frames 6-1, 6-2.

Accordingly, it is possible to enhance precision in arrangement of the partitioning plates 26-1, 26-2, and at the same time to simplify the work for mounting the partitioning plates 26-1, 26-2 to the frames to thereby make it possible to reduce the cost.

Furthermore, in the piezoelectric speaker according to the present invention, the respective vertical frames 2-1, 2-2 on one side and the other side are divided into upper vertical frames 2-1-A, 2-2-A and lower vertical frames 2-1-B, 2-2-B, the respective upper plates 19-1 of the side frames 6-1, 6-2 are assembled between the upper vertical frame 2-1-A on one side and the upper vertical plate 2-2-A on the other side at the right and the left to constitute a frame plate 29-1, the respective lower plates 19-2 of the side frames 6-1, 6-2 are assembled between the lower vertical frame 2-1-B on one side and the lower vertical plate 2-2-B on the other side at the right and the left to constitute a frame plate 29-2, and the vibrating diaphragm 1 is fixed to the frame plates 29-1, 29-2 under the condition that tension in the direction towards the side ends, i.e. in the right-and-left direction is kept applied.

Accordingly, it is possible to maintain the tension of the vibrating diaphragm 1 for a long period of time, to readily assemble, and to prevent the generation of a buzz sound.

Furthermore, in the piezoelectric speaker according to the present invention, the vertical frames 2-1, 2-2 are formed to be longer than the length of the vibrating diaphragm 1 in the right-and-left direction located between the two side frames 6-1, 6-2 and tension in the right-and-left direction is applied to the vibrating diaphragm 1 when the vertical frames 2-1, 2-2 are mounted on the side frames 6-1, 6-2 to assemble the frame.

With such an arrangement, the vibrating diaphragm 1 is first fixed to the side frames 6-1, 6-2, and at this time, the vertical frames 2-1, 2-2 that are longer than the length in the right-and-left direction of the vibrating diaphragm 1 between the pair of side frames 6-1, 6-2 are inserted in between the side frames 6-1, 6-2 so that the vibrating diaphragm 1 is fixed to the frame under the condition that the tension in the right-and-left direction is kept.

Accordingly, the vibrating diaphragm 1 is firmly fixed to the side frames 6-1, 6-2 by the pair of side plates 19-1, 19-2 whereby the manufacturing work is facilitated the generation of the buzz sound is prevented.

DESCRIPTION OF THE PREFERRED EMBODIMENTS

A first embodiment of the present invention will now be described with reference to the accompanying drawing, FIG. 4 which is a perspective view of a piezoelectric speaker for the first to third embodiments of the present invention.

Figure 4:
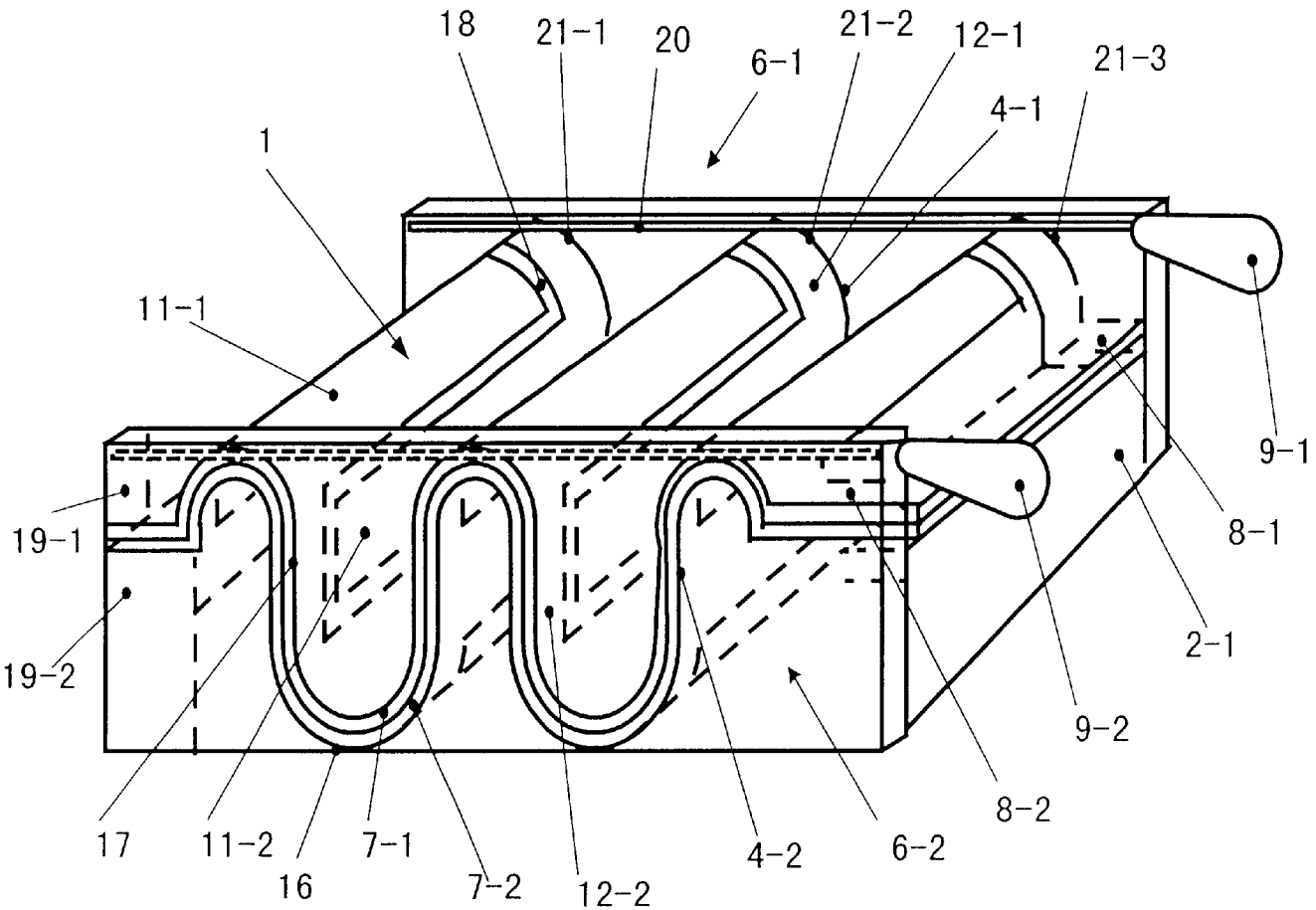
FIG. 4 is a perspective view of the piezoelectric speaker according to the first to third embodiments of the present invention.

As shown in FIG. 4, piezoelectric films 7-1 and 7-2 are bonded together to form a bimorph and molded into a corrugate shape to make a vibrating diaphragm 1. Electrodes 11 are formed on the surface of the piezoelectric film 7-1, 7-2 at crests 16-1, troughs 16-2 and walls 17 of the vibrating diaphragm 1 and electrode leads 12-1, 12-2 are formed at side ends 4-1, 4-2. Since signals input to the electrodes 11-1 of the crests 16-1 and troughs 16-2 and the electrodes 11-2 of the walls 17 are of opposite polarity, the insulating strips 18 are provided.

Subsequently, the side ends 4-1, 4-2 of the vibrating diaphragm 1 are clamped by corrugate surfaces of a pair of plates 19-1 and 19-2 constituting side frames 6-1, 6-2 in conformity with the corrugate shape of the side ends 4-1, 4-2. That is, each of the right and left side frames 6-1, 6-2 fixing the right and left side ends 4-1, 4-2 of the vibrating diaphragm 1 is sectioned into an upper plate 19-1 and a lower plate 19-2 by the side ends 4-1, 4-2 of the vibrating diaphragm 1 formed in a corrugate shape as the whole, and a vibrating diaphragm supporting portion 31 of the upper plate 19-1 and a vibrating diaphragm supporting portion 32 of the lower plate 19-2 are formed in the same corrugate shape as the corrugate shape of the side ends 4-1, 4-2 of the vibrating diaphragm 1 so that the side ends 4-1, 4-2 of the vibrating diaphragm 1 are clamped by the vibrating diaphragm supporting portion 31 of the upper plate 19-1 and the vibrating diaphragm supporting portion 32 of the lower plate 19-2 in the state of the corrugate shape of the vibrating diaphragm 1 being maintained. Leads 20 are fixed to side frames 6-1, 6-2. The electrode leads 12-1, 12-2 and the leads 20 are connected at a plurality of joint points 21-1, 21-2 to each other by conductive paint or the like. Then, the leads 20 are connected to external lead lines 9-1, 9-2.

Figure 1:
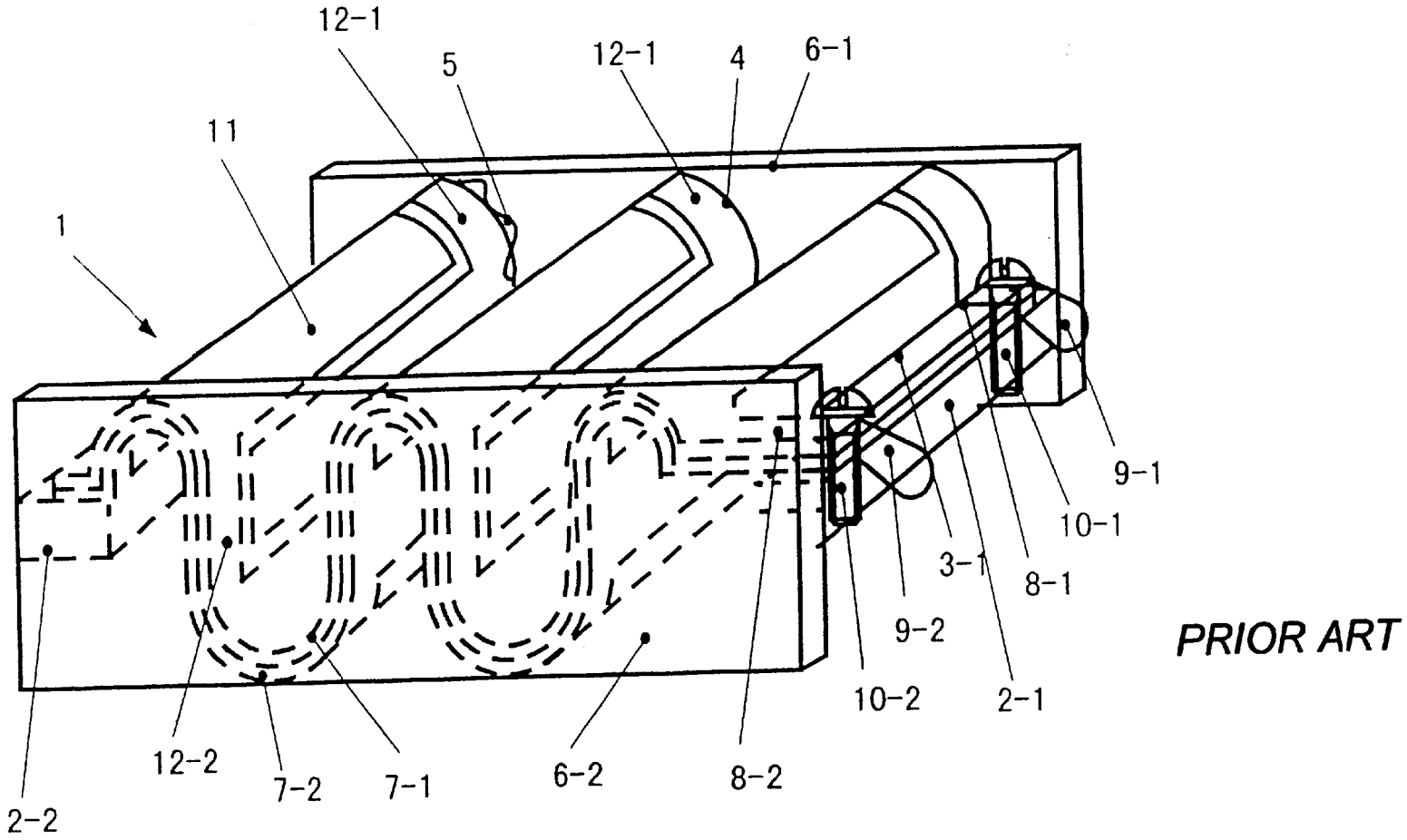
FIG. 1 is a perspective view of a conventional piezoelectric speaker.

Conventionally, as shown in FIG. 1, the vibrating diaphragm 1 and the side frames 6-1, 6-2 fixed together by the adhesives 5 so that the acoustic signal current input from the external lead lines 9-1, 9-2 into the electrode lead terminals 8-1, 8-2 is fed to the electrodes 11 only through the electrode leads 12-1, 12-2.

Since the electrode lead terminals 8-1 and 8-2 and the electrode leads 12-1, 12-2 are thin metal films coated by means of the deposition or the like, if a large current is caused to flow, they may be evaporated and broken down. Then, if the electrodes 12-1, 12-2 and the side frames 6-1, 6-2 made of metal are connected by the conductive paint, the current is diffused and the probability of breakdown of lines is surely reduced.

However, since the adhesives 5 are overflown between the electrode leads 12-1, 12-2 and the side frames 6-1, 6-2, the distance to be connected by the conductive paint is long and the electrode leads 12-1, 12-2 and the side frame 6-1, 6-2 are connected linearly. Since the electrical conductivity of the conductive paint is not so good, there still remains a fear that the conductive paint is broken down or a spark would occur.

Therefore, as in the first embodiment of the present invention in FIG. 4, if the vibrating diaphragm 1 is clamped between a pair of the upper and lower plates 19-1, 19-2 and the vibrating diaphragm 1 is fixed to the side frames 6-1, 6-2, there is no extra adhesives 5 overflown. Accordingly, the electrode leads 12-1, 12-2 the leads 20 may be connected through points at the joint points 21-1, 21-2, 21-3. Then, since the breakdown of the conductive paint no longer occurs and almost all current is caused to flow through the leads 20, there is no breakdown accident of the electrode leads 12-1, 12-2 or the electrode lead terminals 8-1, 8-2.

A second embodiment will now be described. In this embodiment, the side frames 6-1, 6-2 shown in FIG. 4 are made of conductive material such as metal. Namely, the side frames 6-1, 6-2 serve as leads 20. In the same manner as in the first embodiment, the electrode leads 12-1, 12-2 and the side frames 6-1, 6-2 are connected by the conductive paint or the like.

Thus, since the side frames 6-1, 6-2 also serve as the leads 20, the current is caused to flow directly through the side frames 6-1, 6-2 from the external lead lines 9-1, 9-2 to be introduced into the electrode 11-1, 11-2. Therefore, there is no fear of the breakdown of the electrode lead terminals 8-1, 8-2 or the like. Also, since the electrode leads 12-1, 12-2 and the side frames 6-1, 6-2 are connected through points at the joint points 21-1, 21-2, 21-3, it is also possible to prevent the breakdown of the conductive paint.

A third embodiment will now be described with reference to FIG. 4. First of all, the side frames 6-1, 6-2 are made of insulative material such as plastics. Alternatively, in the case where the side frames 6-1, 6-2 are made of conductive material such as metal, the surface is coated with insulative material. In the case where the side frames 6-1, 6-2 are made of insulative material, the leads 20 are fixed to the side frames 6-1, 6-2, but after the fixture, the leads 20 are also coated with insulative material.

It is noted that, if the side frames 6-1, 6-2 are made of conductive material as in the second embodiment, in the case where an user touches the side frame 6-1 by one hand and touches the side frame 6-2 by the other hand, the acoustic signal current stepped up by an amplifier or the like is caused to flow through the human body so that an electrical accident may be occurred. Therefore, the side frames 6-1, 6-2 or the leads 20 having the conductivity are coated with insulative material to thereby prevent the electrical accident.

Figure 5:
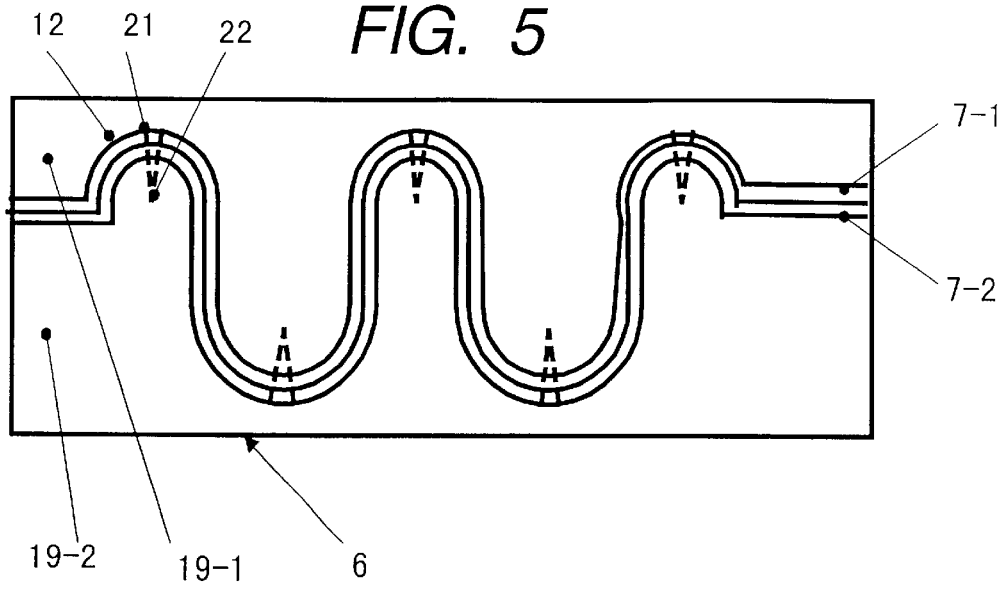
FIG. 5 is a side view of the side frame of the piezoelectric speaker in accordance with the fourth embodiment of the present invention.

Next, in a fourth embodiment, as shown in a side view of the side frame of FIG. 5, projections 22 are formed on the vibrating diaphragm supporting portion 31 in one upper plate 19-1 of the pair of the upper plate 19-1 and the lower plate 19-2. The projections 22 are firmly engaged with the other lower plate 19-2 on the opposite side passing through the electrode lead 12-1 formed on the piezoelectric films 7-1, 7-2.

Thus, the projection 22 becomes joint points 21-1 for connecting the electrode lead 12-1 and the side frame 6-1 to thereby provide a firm electrical connection. Also, the vibrating diaphragm supporting portions 31, 32 in a corrugate shape, of the pair of the upper and lower plates 19-1, 19-2 are engaged with each other to form integral side frames 6-1, 6-2 so that the vibrating diaphragm 1 is prevented from falling apart from the side frames 6-1, 6-2.

Figure 6:
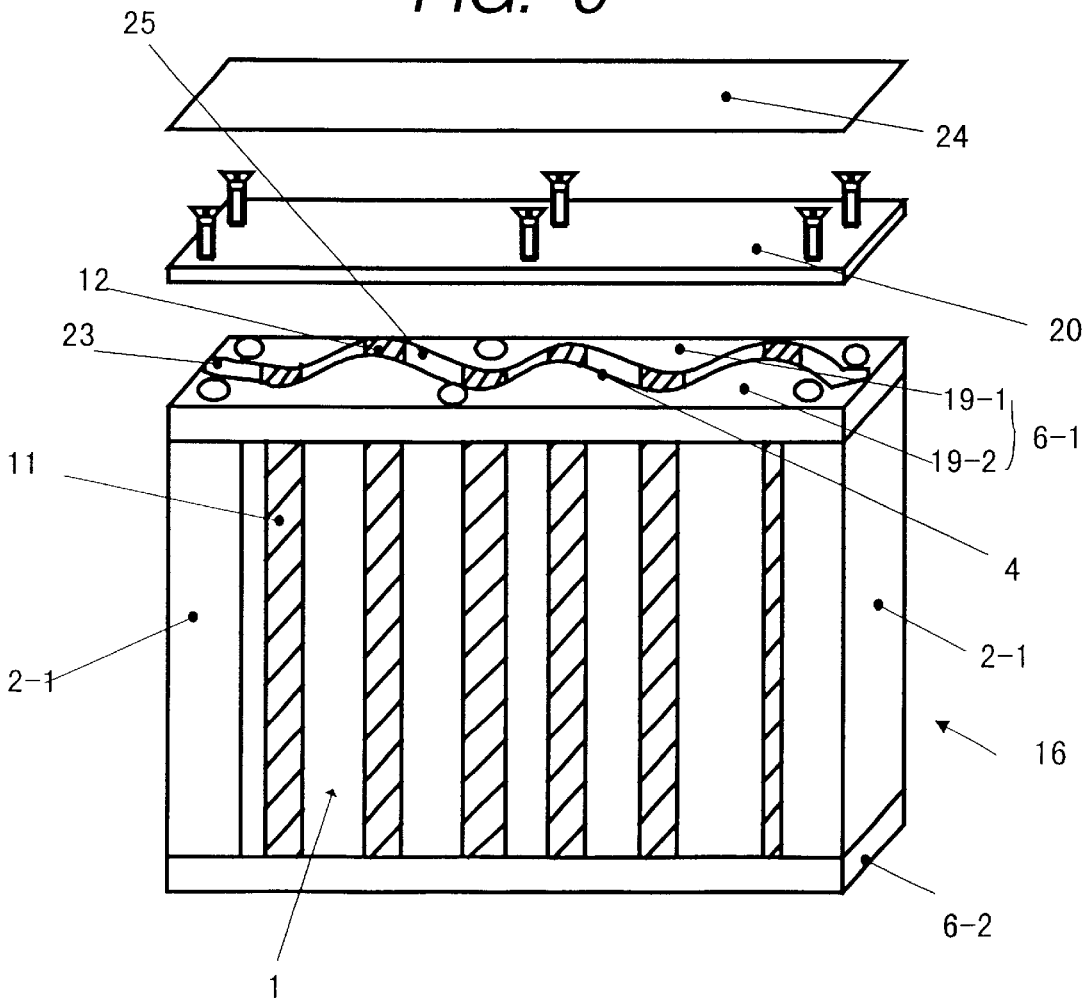
FIG. 6 is a perspective view of the piezoelectric speaker in accordance with the fifth embodiment of the present invention.

Next, in a fifth embodiment, as shown in FIG. 6, the vibrating diaphragm 1 is clamped by the pair of the upper and lower plates 19-1, 19-2 and fixed to the side frames 6-1, 6-2. At this time, the side ends 4-1, 4-2 of the vibrating diaphragm 1 forms projections 23 somewhat projecting from the side frames 6-1, 6-2. Electrode leads 12-1, 12-2 are formed on the projections 23. Then, the leads 20 made of a conductive plate are applied over the projections 23 and screw fastened to the side frames 6 by screws.

Furthermore, insulative plates 24 are bonded over the leads 20. Also, it is possible to bond a conductive tape as a lead 20 instead of the conductive plate or to apply conductive paint. Namely, if the projections 23 are made and the electrode leads 12-1, 12-2 formed on the projections 23 are connected to the leads 20, the technical concept is the same.

Even if the pair of the upper and lower plates 19-1, 19-2 are made of conductive material such as metal as in the second embodiment, unless the projections 22 shown in FIG. 5 is provided, it is not sufficient to provide the firm electrical connection between the side frames 6-1, 6-2 and the electrode leads 12-1, 12-2. Also, there is a fear that the vibrating diaphragm 1 may fall apart from the side frames 6-1, 6-2.

Therefore, as shown in FIG. 6, the leads 20 are applied over the projections 23, and the electrode leads 12-1, 12-2 are press fitted to the side frames 6-1, 6-2 and the leads 20, so that it is possible to prevent the vibrating diaphragm 1 from falling apart from the side frames 6-1, 6-2 and it is also possible to obtain a sufficient electrical connection.

In the case where the side frames 6-1, 6-2 are made of metal, it is possible to make the leads 20 of insulative material. In this case, the side frames 6-1, 6-2 provide the electrical conductivity and serve as the leads 20. Also, in the case where the pair of the upper and lower plates 19-1, 19-2 are made of insulative material, if the leads 20 are made of conductive material, it is possible to obtain a sufficient electrical conductivity. Furthermore, the insulative plates 24 may be bonded to the side frames 6-1, 6-2 to thereby eliminate a fear of electrical accident even if a hand touches the side frames 6-1, 6-2.

Incidentally, although not shown in the drawings, in the case where the thus produced piezoelectric speaker unit is used with being embedded in the wall or the like, since it is possible to make a structure such that the leads 20 can no longer be touched by a hand or the like the leads 20, it is unnecessary to particularly bond the insulative plates 24.

Figure 2:
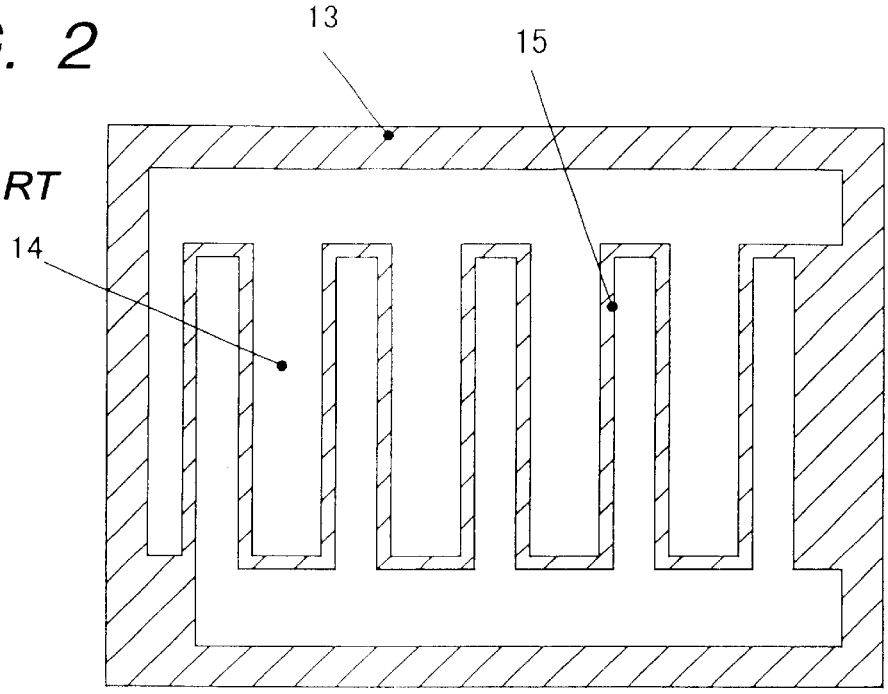
FIG. 2 PRIOR ART
FIG. 2 is a plan view of a mask used for manufacturing an electrode pattern in accordance with the first to third embodiments of the present invention.

As FIG. 2 shows a plan view of a mask for manufacturing an electrode pattern used in the embodiment of the piezoelectric speaker shown in FIG. 4, when an electrode is formed by means of vapor deposition, etching or the like, a mask corresponding to the electrode pattern is required.

The mask will now be described with reference to FIG. 2. As shown in FIG. 2, the mask is obtained as the remainder, i.e. an insulative strip portion 15 indicated by hatching, after an electrode portions 14, which are blanks without hatching, are removed from a thin iron plate 13. While the mask pattern so obtained may be used to form an electrode in the present invention, the insulating strip portion 15 tends to bend and hardly keeps the position, since it is narrow and thin with the width of around 2 mm.

Figure 3:
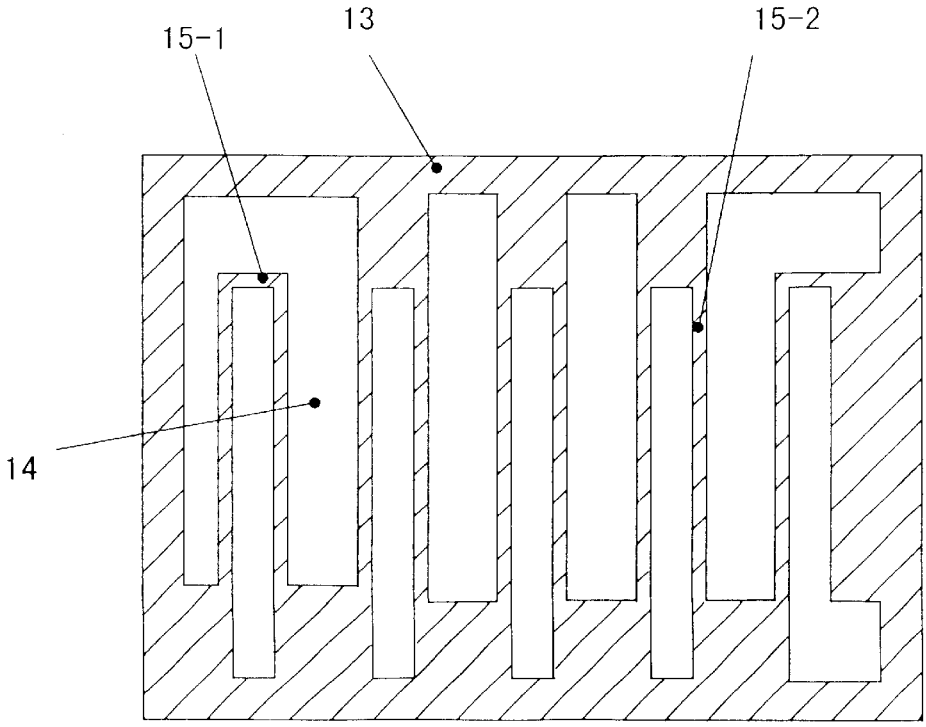
FIG. 3 is a plan view of the mask for manufacturing an electrode pattern in accordance with the sixth embodiment of the present invention.

Then, in order to enhance the precision of the mask, the mask shown in FIG. 3 is used. This mask is formed by removing the electrode portions 14 indicated by blanks for forming the electrodes 11-1, 11-2 from the thin iron plate 13. Namely, thus, the insulative strip portions 15-1, 15-2 or the like are left in the iron plate 13. Since the insulative strip portions 15-1, 15-2 are not contiguous like the insulative strip portion 15 of the conventional mask shown in FIG. 2, there is no fear of bends or displacement.

Accordingly, the electrode pattern manufactured by using the mask shown in FIG. 3 has a high precision, but disconnected portions 25 of the electrode leads 12-1, 12-2 are generated as shown in FIG. 6. However, as described above, the projections 23 are press bonded by the leads 20 so that each of electrodes 11-1, 11-2 is connected by the leads 20 and the joint points 21 (see FIG. 5). Thus, the fact that the sufficient electrical conductivity can be obtained through the leads 20 to the external lead lines 9-1, 9-2 is the same as in the fifth embodiment.

Figure 7:
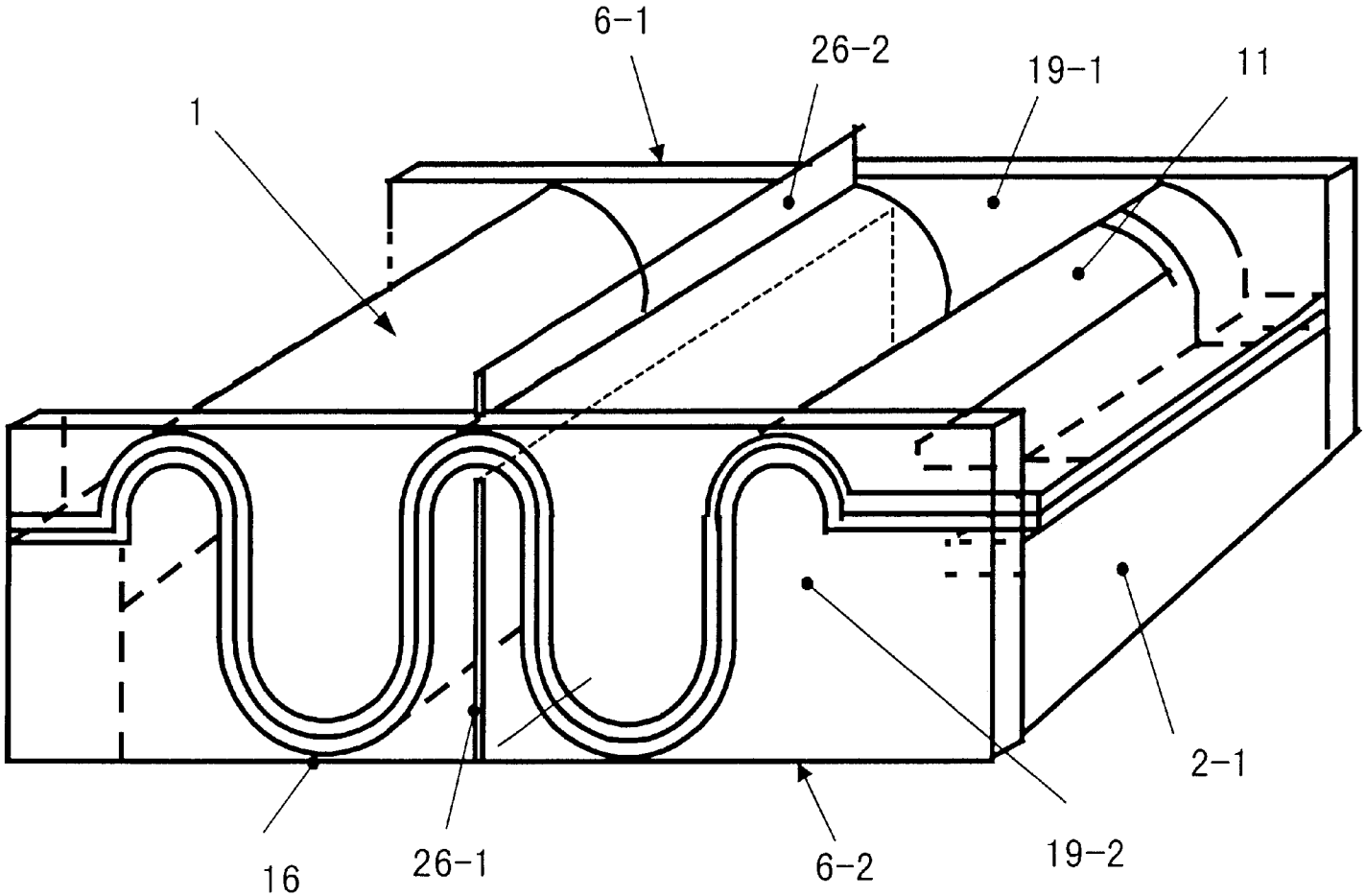
FIG. 7 is a perspective view of the piezoelectric speaker in accordance with the seventh embodiment of the present invention.

A seventh embodiment will now be described. As shown in FIG. 7, in this embodiment, partitioning plates 26-1, 26-2 are inserted in a sound radiating surface in order to hold the tops of the crests 16-1 and the bottoms of the troughs 16-2 of the vibrating diaphragm 1 formed in a continuous curved shape with partitioning plates 26-1, 26-2 at the upper and lower surfaces so that the vibrating diaphragm 1 does not move. Namely, the partitioning plates 26-1, 26-2 are inserted onto the upper and lower surfaces between the two side frames 6-1, 6-2 in the vicinity of the top of the crests 16-1 and the bottom of troughs 16-2. Namely, the partitioning plates 26-1, 26-2 are inserted in the direction for radiating the sound. It is most preferable to insert the partitioning plates 26-1, 26-2 into every crest 16-1 and trough 16-2. However, it is not always necessary to insert the partitioning plates 26-1, 26-2 into every crest 16-1 and trough 16. FIG. 7 typically shows the case of the two partitioning plates 26-1, 26-2.

If a number of partitioning plates 26-1, 26-2 are arranged to be inserted into each crest 16-1 or trough 16-2, the distance between the adjacent partitioning plates 26-1, 26-2 is narrow so that the finger could not be inserted therein. Accordingly, since the finger or the like no longer touches the electrode 11-1 of the vibrating diaphragm 1, it is possible to prevent the electrical accident. Also, the partitioning plates 26-1, 26-2 become walls for preventing the adverse affect to the vibration of the adjacent crest 16-1 and trough 16-2 to thereby make it possible to prevent the buzz sound and to keep the sound pressure frequency characteristics in good condition. Namely, the piezoelectric speaker according to the present invention may radiate sound in the same manner either from a front side or a back side.

Figure 8:
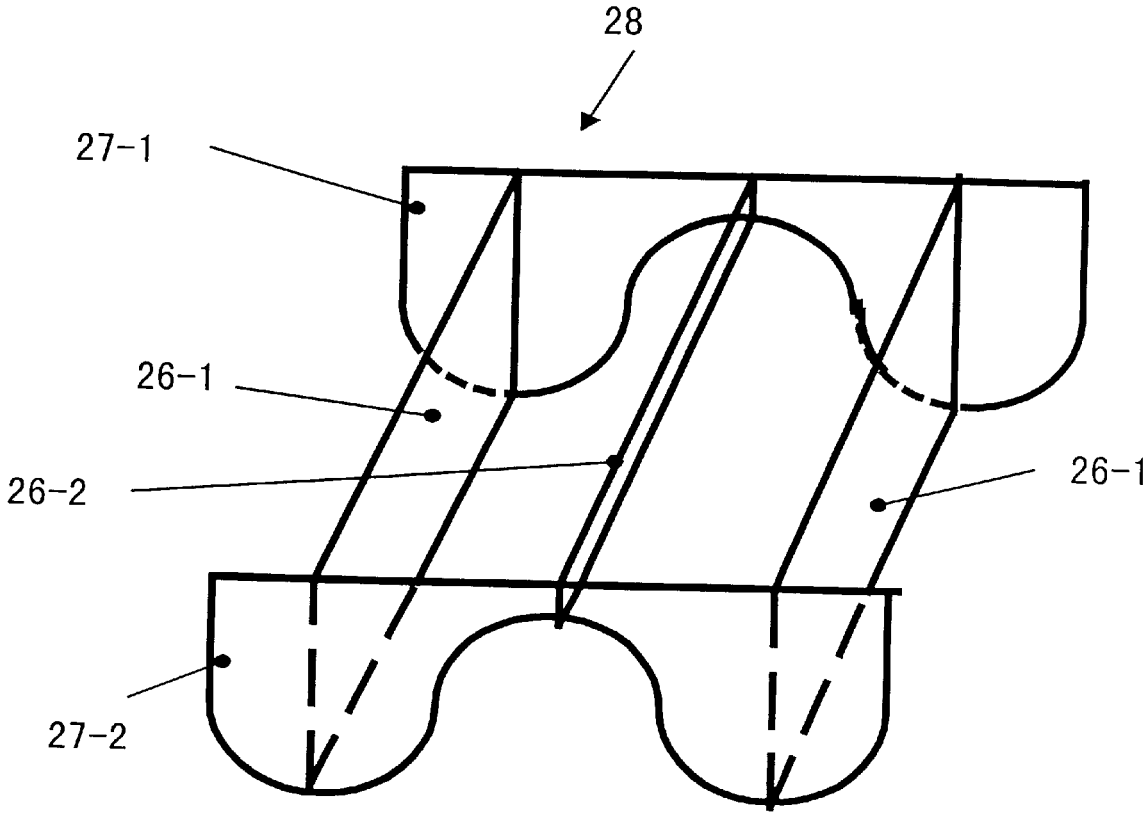
FIG. 8 is a perspective view of the partitioning plate in accordance with the eighth embodiment of the present invention.

An eighth embodiment will now be described with reference to FIG. 8. In this embodiment, the partitioning plates 26-1, 26-2 are formed integrally with the side frames 6-1, 6-2. Alternatively, a partitioning plate assembly 28, in which the partitioning plates are formed integrally with the side plates 27-1, 27-2 in conformity with the side frames 6-1, 6-2, may be inserted between the two side frames 6-1, 6-2.

The effect thereof is the same as that of the seventh embodiment. In particular, the side plates 27-1, 27-2 may be regarded as parts of the side frames 6-1, 6-2 in this embodiment. Also, since the partitioning plates 26-1, 26-2 and the side frames 6-1, 6-2 or the side plates 27-1, 27-2 are formed integrally, it is possible to reduce the number of manufacturing steps for inserting the partitioning plates 26-1, 26-2 to thereby reduce the cost.

Figure 9:
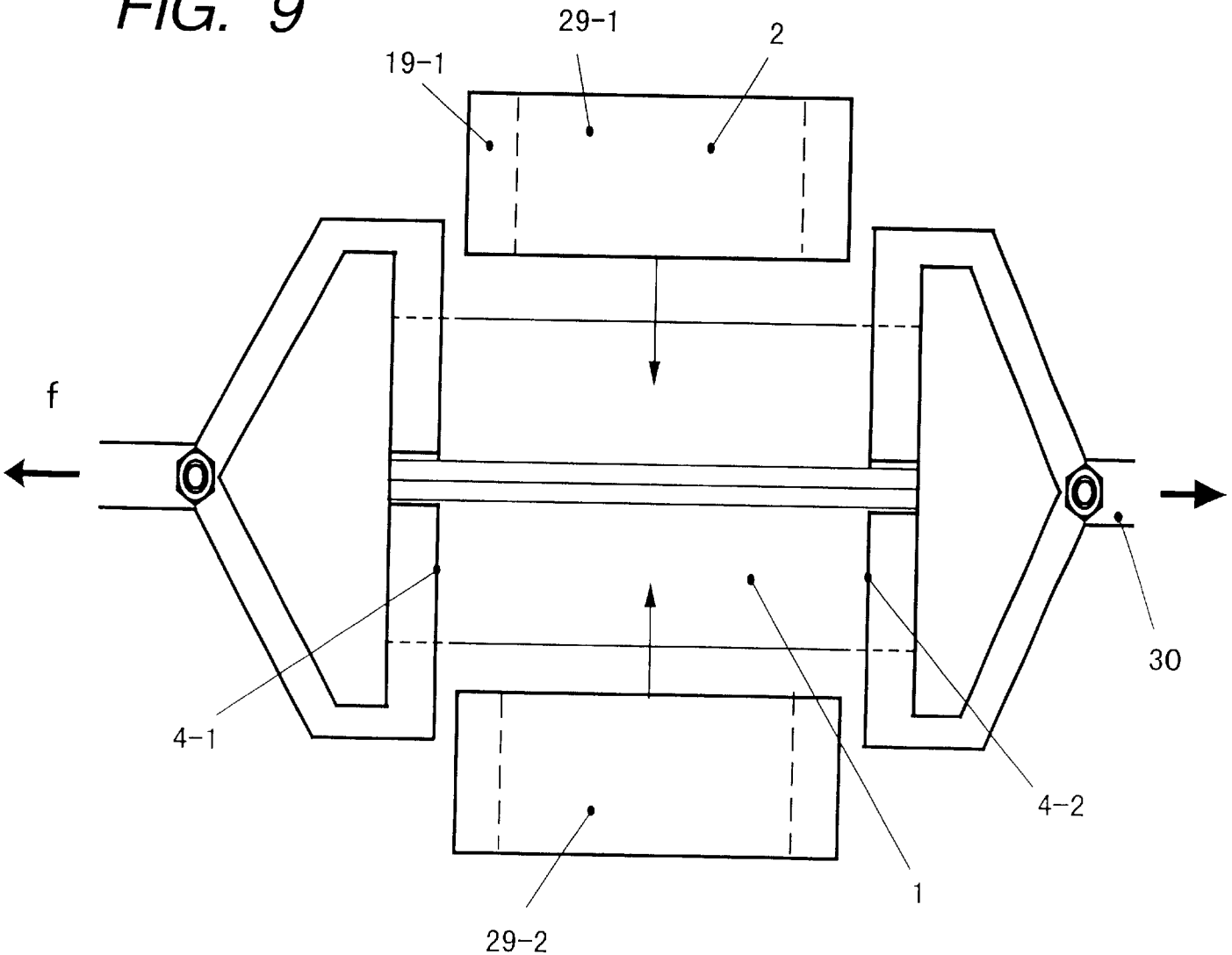
FIG. 9 is a view illustrative of the piezoelectric speaker and the manufacturing method of the piezoelectric speaker in accordance with the ninth embodiment of the present invention.

Subsequently, in a ninth embodiment, as shown in FIG. 9, the respective vertical frames 2-1, 2-2 are divided into two of upper and lower parts. Although the example shown in the figure is for the vertical frame 2-1 of one side, the same is applicable to the vertical frame 2-2 of the other side. The upper part of thus divided vertical frame 2-1 is indicated as 2-1-A and the lower part is indicated as 2-1-B. As for the vertical frame 2-2, which is not illustrated, the upper part thereof is 2-2-A and the lower part is 2-2-B. Then, the upper plates 19-1 is previously assembled to the upper vertical frame 2-1-A to constitute a frame plate 29-1. On the other hand, the lower plates 19-2 is also previously assembled to the lower vertical frame 2-1-B to constitute a frame plate 29-2. Subsequently, the side ends 4-1, 4-2 of the vibrating diaphragm 1 are pulled by a force f in the right-and-left direction in FIG. 9 by means of a tensioning unit 30. It is preferable that the tension thereof causes the extension in the right-and-left direction by about one percent. Then, the vibrating diaphragm 1 is clamped by the frame plates 29-1 and 29-2 from above and below and fixed thereto under the extended condition.

Accordingly, under the condition that the tension is applied to the vibrating diaphragm 1 in the right-and-left direction, the vibrating diaphragm 1 is fixed to the frame constituted by the vertical frames 2-1, 202 and the side frames 6-1, 6-2. Thus, according to this embodiment, if the tension is applied to the vibrating diaphragm 1 in the right-and-left direction, it has been confirmed that the trembling sound that is noise generated from the vibrating diaphragm 1 can be reduced.

A tenth embodiment will now be described.

In case of this example too, the respective vertical frames 2-1, 2-2 are divided into two of upper and lower parts. Although the example shown in the figure is for the vertical frame 2-1 of one side, the same is applicable to the vertical frame 2-2 of the other side. The upper part of thus divided vertical frame 2-1 is indicated as 2-1-A and the lower part is indicated as 2-1-B.

Figure 10:
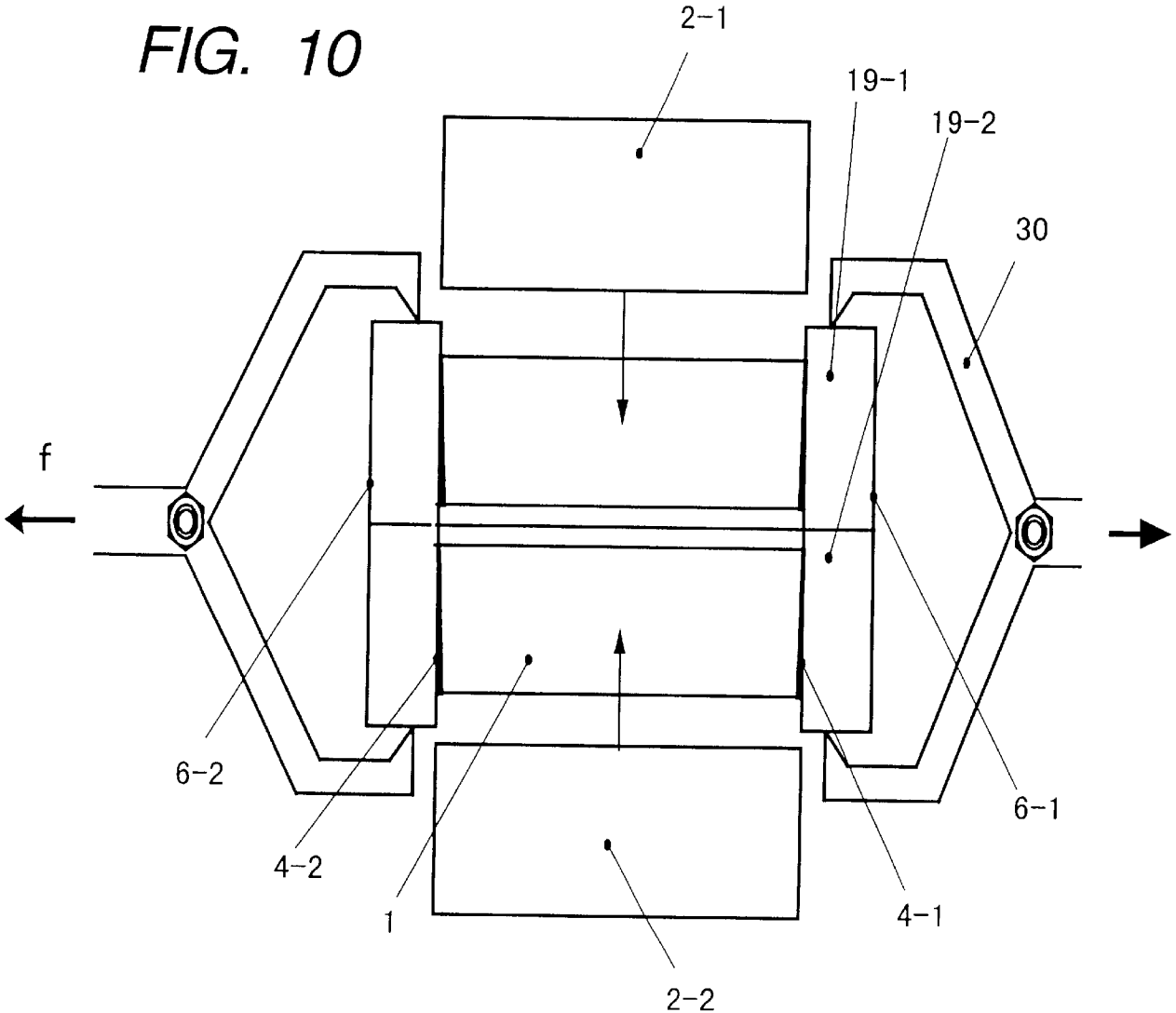
FIG. 10 is a view illustrative of the piezoelectric speaker and the manufacturing method of the piezoelectric speaker in accordance with the tenth embodiment of the present invention.

As shown in FIG. 10, first of all, the side ends 4-1, 4-2 of the vibrating diaphragm 1 are clamped by the pair of the upper and lower plates 19-1, 19-2 and fixed to the two side frames 6-1, 6-2. At this time, vertical frames 2-1, 2-2 that are longer than the length between the two side frames 6-1, 6-2 are prepared. Subsequently, the side frames 6-1, 6-2 are clamped by the tensioning unit 30 to apply to the vibrating diaphragm 1 the force f in the right-and-left direction in FIG. 10. It is preferable that this force causes a condition that the right-and-left extension of the vibrating diaphragm 1 is about one percent, as in the ninth embodiment. Then, when the vertical frames 2-1, 2-2 are inserted between the two side frames 6-1, 6-2 and assembled, it is possible to firmly fix the vibrating diaphragm 1 to the side frames 6-1, 6-2 under the condition that the tension in the right-and-left direction is applied for a long period time.

The effect of the present invention will now be described.

As described above in detail, according to the first aspect of the present invention, the side ends in a corrugate shape are clamped by means of a pair of plates so that the vibrating diaphragm may be firmly fixed to the side frames. Also, it is possible to prevent the current from being concentrated onto the local position of the thin electrode lead terminals.

According to the second aspect of the present invention, it is possible to connect the electrodes and the leads at a plurality of positions with ease and without fail while not imparting the adverse affect to the vibrating surface.

According to the third aspect of the present invention, since it is possible to avoid the adverse affect of the vibration due to the operation and sound wave of the adjacent cell and to prevent the finger from touching the vibrating diaphragm because of the insertion of the partition plates, this is a sufficient countermeasure to the electrical accident and thus it is possible to solve at once the two problems of the prevention of the electrical accident and the prevention of the buzz sound.

According to the fourth aspect of the present invention, it is possible to enhance precision in arrangement of the partition plates and at the same time to reduce the cost since the work for mounting the partitioning plates to the frames may readily be performed.

According to the fifth aspect of the present invention, it is possible to keep the tension of the vibrating diaphragm for a long period of time and at the same time to readily assemble it to thereby prevent the generation of the buzz sound.

What is claimed is:

1. A piezoelectric speaker, comprising:

a vibrating diaphragm 1, formed by two piezoelectric films 7-1, 7-2 being put together and made in a bimorph type, and formed into a corrugate shape as the whole to have crests 16-1 and troughs 16-2 alternately and to have walls 17 which connect the crests 16-1 and the troughs 16-2, wherein said vibrating diaphragm 1 is structured such that side ends 4-1, 4-2 corresponding to the right and left ends of the vibrating diaphragm 1 are attached to side frames 6-1, 6-2 placed at the right and the left of the vibrating diaphragm 1 and one longitudinal end 3-1 and the other longitudinal end 3-2 of the vibrating diaphragm 1 are attached to vertical frames 2-1, 2-2 disposed between the right and left side frames 6-1, 6-2 and that electrodes 11-1, 11-2 are formed on the vibrating diaphragm 1 to generate sound waves by alternate signals being input to the electrodes 11-1, 11-2, wherein each of the right and left side frames 6-1, 6-2 fixing the right and left side ends 4-1, 4-2 of the vibrating diaphragm 1 is sectioned into an upper plate 19-1 and a lower plate 19-2 by the right side end 4-1 or the left side end 4-2 of the vibrating diaphragm 1 formed in the corrugate shape as the whole; and a vibrating diaphragm supporting portion 31 of the upper plate 19-1 and a vibrating diaphragm supporting portion 31 of the upper plate 19-1 and a vibrating diaphragm supporting portion 32 of the lower plate 19-2 are formed in a corresponding corrugate shape as the corrugate shape of the side ends 4-1, 4-2 of the vibrating diaphragm 1 so that the side ends 4-1, 4-2 of the vibrating diaphragm 1 are clamped by the vibrating diaphragm supporting portion 31 of the upper plate 19-1 and the vibrating diaphragm supporting portion 32 of the lower plate 19-2 in the state of the corrugate shape of the vibrating diaphragm 1 being maintained.

2. The piezoelectric speaker according to claim 1, wherein the vibrating diaphragm 1 is clamped by the upper plate 19-1 and the lower plate 19-2 in such a way that the side ends 4-1, 4-2 of the vibrating diaphragm 1 project from the side frames 6-1, 6-2, electrode leads 12-1, 12-2 are formed on projections 23 so projected, and the electrode leads 12-1, 12-2 are connected by the leads 20.

3. The piezoelectric speaker according to claim 1, wherein partitioning plates 26-1, 26-2 are inserted between the two side frames 6-1, 6-2, and the crests 16-1 and the troughs 16-2 of the vibrating diaphragm 1 are partitioned by the partitioning plates 26-1, 26-2.

4. The piezoelectric speaker according to claim 1, wherein the partitioning plates 26-1, 26-2 are formed integrally with the side frames 6-1, 6-2.

5. The piezoelectric speaker according to claim 1, wherein the respective vertical frames 2-1, 2-2 on one side and the other side are divided into upper vertical frames 2-1-A, 2-2-A and lower vertical frames 2-1-B, 2-2-B, the respective upper plates 19-1 of the side frames 6-1, 6-2 are assembled between the upper vertical frame 2-1-A on one side and the upper vertical plate 2-2-A on the other side at the right and the left to constitute a frame plate 29-1, the respective lower plates 19-2 of the side frames 6-1, 6-2 are assembled between the lower vertical frame 2-1-B on one side and the lower vertical plate 2-2-B on the other side at the right and the left to constitute a frame plate 29-2, and the vibrating diaphragm 1 is fixed to the frame plates 29-1, 29-2 under the condition that tension in the direction towards the side ends, i.e. in the right-and-left direction is kept applied.

6. The piezoelectric speaker according to claim 1 wherein the vertical frames 2-1, 2-2 are formed to be longer than the length in the right-and-left direction of the vibrating diaphragm 1 located between the two side frames 6-1, 6-2 and tension in the right-and-left direction is applied to the vibrating diaphragm 1 when the vertical frames 2-1, 2-2 are mounted on the side frames 6-1, 6-2 to assemble the frame.

7. A piezoelectric speaker, comprising:

a vibrating diaphragm bimorphly formed by a plurality of piezoelectric films and formed in a corrugate shape having crests and troughs, and being formed with a first side end and a second side end, the first side end corresponding to a first wall and the second side end corresponding to a second wall for connecting the crests and the troughs of the piezoelectric films such that the first wall is attached to a first side frame and the second wall is attached to a second side frame, the first side frame and the second side frame being placed at opposing sides of the vibrating diaphragm;

a first longitudinal end of the vibrating diaphragm that is attached to a first vertical frame;

a second longitudinal end of the vibrating diaphragm that is attached to a second vertical frame, wherein the first and second vertical frames are disposed between the first side frame and the second side frame; and at least one electrode formed on the vibrating diaphragm to generate sound waves by signals being input into the electrode, wherein the first side frame is sectioned into an upper plate and a lower plate by the first side end, and the second side frame is sectioned into and upper plate and a lower plate by the second side end; and a vibrating diaphragm supporting portion of the each upper plate and a vibrating diaphragm supporting portion of each lower plate that are formed in a corrugate shape corresponding to the corrugate shape of the first side end and the second side end of the vibrating diaphragm such, wherein the first side end and the second side end are attached to the vibrating diaphragm supporting portion of the upper plate and the vibrating diaphragm supporting portion of the lower plate.

8. The piezoelectric speaker according to claim 7, further comprising:

at least one projection that is formed by the vibrating diaphragm attaching to the upper plate and the lower plate such that the first and the second side ends project from the corresponding first and second side frames;

a lead attached to the first side frame or to the second side frame; and a plurality of electrode leads, formed on the at least one projection, connected by the lead.

9. The piezoelectric speaker according to claim 7, further comprising:

a partitioning plate inserted between the first side frame and the second side frame, wherein the crests and the troughs of the vibrating diaphragm are partitioned by the partitioning plate.

10. The piezoelectric speaker according to claim 9, wherein the partitioning plate is formed integrally with the first side frame and the second side frame.

11. The piezoelectric speaker according to claim 7, wherein the first vertical frame is divided into an upper vertical frame and a lower vertical frame, and the second vertical frame is divided into an upper vertical frame and a lower vertical frame, wherein the upper plate of the first side frame and the upper plate of the second side frame are assembled between the first upper vertical frame and the second upper vertical frame to constitute a first frame plate, the lower plate of the first side frame and the lower plate of the second side frame are assembled between the first lower vertical frame and the second lower vertical frame to constitute a second frame plate, and the vibrating diaphragm is attached to the first and second frame plates such that tension is applied to the diaphragm in the direction towards the first side end and the second side end.

12. The piezoelectric speaker according to claim 7, wherein a length of the first vertical frame and a length of the second vertical frame are formed longer than vibrating diaphragm in a direction disposed between the first side frame and the second side frame.

13. The piezoelectric speaker according to claim 12, wherein the first side frame and the second side frame are attached to the first vertical frame and the second vertical frame, respectively, such that tension is applied to the vibrating diaphragm.

14. The piezoelectric speaker according to claim 7, wherein the first side end is attached to the first side frame by clamping and the second side end is attached to the second side frame by clamping.

15. The piezoelectric speaker according to claim 7, wherein the first side end is attached to the first side frame by clamping the first side end between the upper portion of the first side frame and the lower portion of the first side frame, and the second side end is attached to the second side frame by clamping the second side end between the upper portion of the second side frame and the lower portion of the second side frame.

16. A piezoelectric speaker, comprising:

a first side plate comprising a non-linear upper portion which corresponds to a non-linear lower portion;

a second side plate comprising a non-linear upper portion which corresponds to a non-linear lower portion;

a piezoelectric film comprising a non-linear first side-end attached to the non-linear upper portion and to the non-linear lower portion of the first side plate and comprising a non-linear second side-end, opposed to the non-linear first side-end, that is attached to the non-linear upper portion and to the non-linear lower portion of the second side plate;

a first vertical frame attached to a first longitudinal end of the piezoelectric film;

a second vertical frame attached to a second longitudinal end of the piezoelectric film, opposed to the first longitudinal side-end, wherein the first vertical frame and the second vertical frame are each attached to the first side plate and the second side plate to form a piezoelectric speaker frame; and at least one electrode formed on the vibrating diaphragm, wherein a signal that is inputted into the electrode generates a sound wave.

17. The piezoelectric speaker of claim 16, wherein the non-linear first side end and the non-linear second side end form a corrugate pattern when attached to the first side plate and to the second side plate, respectively.

18. The piezoelectric speaker of claim 16, wherein the non-linear upper portion and the non-linear lower portion of the first side plate correspond to the non-linear first side end, and the non-linear upper portion and the non-linear lower portion of the second side plate correspond to the non-linear second side-end.

19. The piezoelectric speaker according to claim 16, further comprising:

at least one projection formed by attaching the vibrating diaphragm to the upper portion of the first side plate and to the lower portion of the first side plate such that the first non-linear side-end projects from the first side frame;

at least one lead attached to the first side frame; and a plurality of electrode leads, connected by the at least one lead, formed on the at least one projection.

20. The piezoelectric speaker according to claim 16, further comprising:

a partitioning plate inserted between the first side frame and the second side frame, wherein the non-linear vibrating diaphragm is partitioned by the partitioning plate.

* * * * *